United States Patent [19]

Liebrich et al.

[11] 4,323,320

[45] Apr. 6, 1982

[54] LIGHT-REFLECTING ARRANGEMENT FOR USE IN TRAFFIC CONTROL DEVICES

[75] Inventors: Wolfgang Liebrich; Dieter Schneider, both of Buchen, Fed. Rep. of Germany

[73] Assignee: Odenwälder Kunststoffwerke GmbH, Buchen, Fed. Rep. of Germany

[21] Appl. No.: 156,588

[22] Filed: Jun. 5, 1980

[30] Foreign Application Priority Data

Jun. 5, 1979 [LU] Luxembourg ..... 81365

[51] Int. Cl.[3] ..... E01F 9/00

[52] U.S. Cl. ..... 404/10; 40/611

[58] Field of Search ..... 404/10, 11, 9; 40/611, 40/618

[56] References Cited

U.S. PATENT DOCUMENTS

| | | | |
|---|---|---|---|
| 1,766,841 | 6/1930 | Sherman | 404/10 |
| 2,224,937 | 12/1940 | Stedman | 404/11 |
| 2,808,803 | 10/1957 | Weig | 404/10 X |
| 3,693,511 | 9/1972 | Medynski | 404/10 |
| 3,820,911 | 6/1974 | Bays | 404/11 |
| 4,088,415 | 5/1978 | Syak | 404/10 X |
| 4,245,922 | 1/1981 | Auriemma | 404/10 |

*Primary Examiner*—Nile C. Byers, Jr.

*Attorney, Agent, or Firm*—Kontler & Grimes

[57] ABSTRACT

A light-reflecting arrangement includes a stack of clean light-reflecting plates which are mounted on a support for gradual advancement, one after the other, into an operative position in which the respective light-reflecting plate replaces the previous one which may have become soiled while dwelling in its operating position, so that a relatively clean plate will be exposed in the operative position at all times to act as a reflector for oncoming traffic. The light-reflecting plates which have been replaced descend by gravity either to form another stack of used light-reflecting plates, or to be collected in a receptacle. The stack of the light-reflecting plates may be advanced by a pusher or by a threaded shaft cooperating with a threaded bore of the respective light-reflecting plate. The pusher may be advanced or the threaded shaft may be rotated by a spring-energized or a battery-energized motor, or by a drive which is energized by ambient pressure or temperature fluctuations.

16 Claims, 9 Drawing Figures

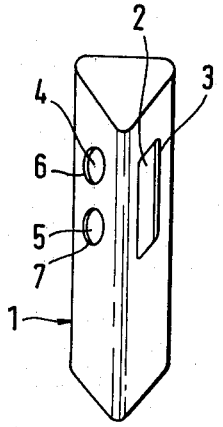
FIG. 1
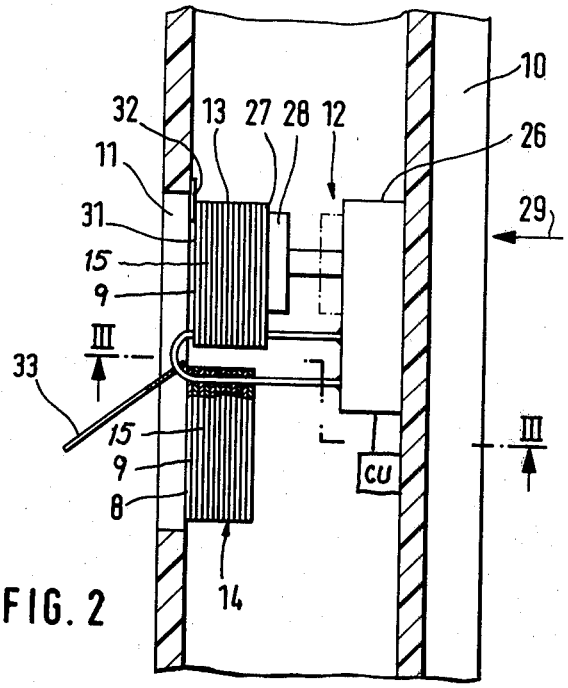
FIG. 2
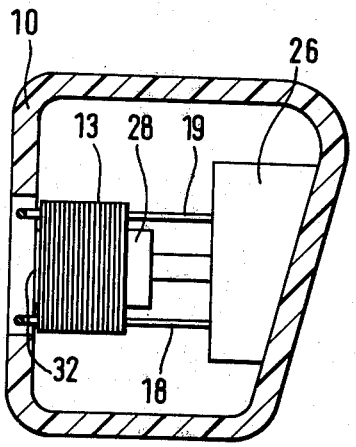
FIG. 3
FIG. 4
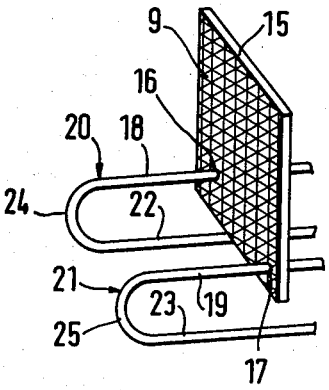

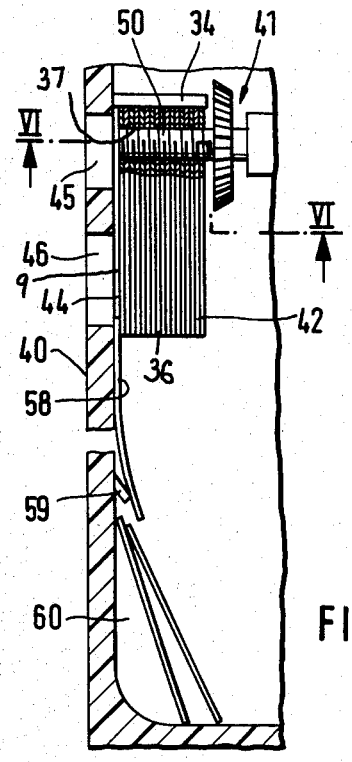
FIG. 5
FIG. 6
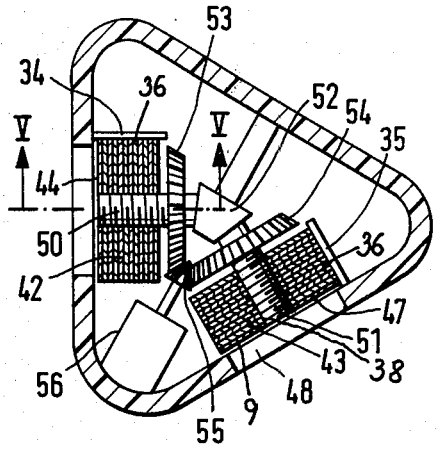
FIG. 7
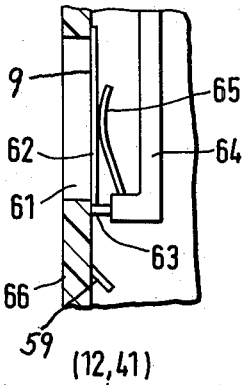
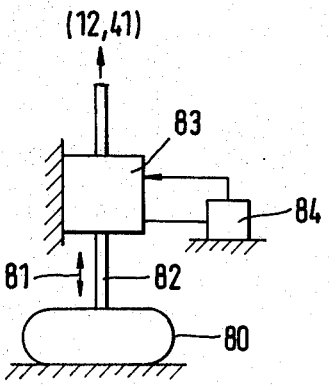
FIG. 8
FIG. 9
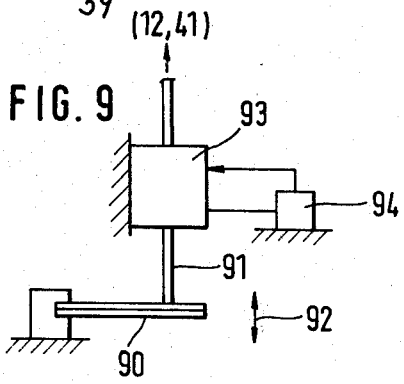

LIGHT-REFLECTING ARRANGEMENT FOR USE IN TRAFFIC CONTROL DEVICES

BACKGROUND OF THE INVENTION

The present invention relates to a light-reflecting arrangement, particularly for use in traffic control devices such as roadside markers, or the type wherein the period during which the light-reflecting arrangement keeps its light-reflecting properties is extended by insuring that the light-reflecting surface which is presented to view of drivers of oncoming traffic is free of obscuring impurities.

It is well known that the light-reflecting surfaces of traffic signs, roadside markers or other traffic control or guidance devices become obscured during the use of such devices by deposition of dust, dirt, mud and other obscuring impurities thereon. Therefore, it is necessary to periodically remove such obscuring impurities by washing or otherwise cleansing the affected surfaces of such traffic control devices. This can be done either manually or by means of a washing or cleaning apparatus mounted on a vehicle. However, this is rather expensive, particularly in view of the fact that such traffic control devices are widely distributed along the highway network, which means that the roadway sign maintenance personnel has to periodically travel long distances until all of the widely distributed traffic control devices are cleansed.

To alleviate this situation, it has been proposed, in the German application No. 22 25 307 laid open for public inspection, to provide an automatic cleaning arrangement for use in traffic control devices which utilizes an endless band constituted by a transparent foil as a protective film, the band being advanced by a spring-energized motor and passing in front of the light-reflecting surface of the light-reflecting arrangement during its advancement. Then, those portions of the endless band which have passed in front of the light-reflecting surface are passed through a cleansing bath before they are returned, in their cleansed condition, to their position of juxtaposition with the light-reflecting surface. As advantageous as this prior-art arrangement may be in some respects, it is disadvantageous in certain other respects. So, for instance, because of the use of the transparent foil, which is quite sensitive to a mechanical damage and likely to deteriorate when exposed to the ravages of weather, the life span of the endless band is quite limited. Furthermore, the band merely shields the light-reflecting surface but does not completely prevent penetratation of dust particles and the like toward the light-reflecting surface where such obscuring impurities could still deposit and thus interfere with the light-reflcting capability of this light-reflecting surface. This, of course, is very disadvantageous.

OBJECTS AND SUMMARY OF THE INVENTION

Accordingly, it is a general object of the present invention to avoid the disadvantages of the prior art.

More particularly, it is an object of the present invention to provide a light-reflecting arrangement, particularly for use in traffic control devices such as roadside markers, which is not possessed of the disadvantages of the conventional devices of this type.

A further object of the present invention is to so construct the arrangement of the type here under consideration as to extend its useful life as compared to that of the prior-art arrangements.

A concomitant object of the present invention is to so design the light-reflecting arrangement as to be simple in construction, easy to install, require low maintenance costs, and be reliable in operation nevertheless.

In pursuance of these objects and others which will become apparent hereafter, one feature of the present invention resides in a light-reflecting arrangement, particularly for use in traffic control devices such as roadside markers, which arrangement, briefly stated, comprises a support; a stack of light-reflecting plates mounted on the support for successive advancement of the individual light-reflecting plates of the stack toward and beyond an operative position in which the respective light-reflecting plate is exposed to act as a reflector; and means for gradually advancing the light-reflecting plates of the stack to replace that light-reflecting plate which may have lost its reflecting capability while dwelling in the operative position by the next-succeeding light-reflecting plate of the stack.

While the respective light-reflecting plate assumes its operative position, it is, for instance, situated in a recess or behind an opening or window of the traffic control device so that its light-reflecting surface faces outwardly of the traffic control device and forms the reflector. The light-reflecting plate which has already assumed its operative position for some time and which may have become soiled is replaced, in a replacing operation, by the next-succeeding, still clean, light-reflecting plate from the stack. Only when all light-reflecting plates originally forming the stack have already been used must the maintenance personnel get involved and remove the soiled light-reflecting plates and introduce a new stack of clean light-reflecting plates into the traffic control device and, if need be, restore the advancing means of the arrangement to its original condition.

Advantageously, the light reflecting plates are so mounted on the support that a leading one of these plates loses its footing upon reaching an end position and descends from the stack by gravity. The leading light-reflecting plate may reach its operative position prior to or subsequent to reaching the above-mentioned end position. It is further advantageous when the light-reflecting plates are so mounted on the support as to form another stack after their descent by gravity from the first-mentioned stack.

In one advantageous embodiment of the present invention, the light-reflecting arrangement includes detaining means which captures that light-reflecting plate which has just descended by gravity from the end position and which holds this plate in the operative position until the time of replacement by the next-succeeding light-reflecting plate, and means for accumulating those light-reflecting plates which have been released by the detaining means. Advantageously, the detaining means includes a holding element extending into the path of descent of the light-reflecting plates from the end position when assuming one position, and retracting from the aforementioned path in another position so as to release the light-reflecting plates for further descent by gravity into the accumulating means which may include a receptacle situated underneath the detaining means.

According to a currently preferred aspect of the present invention, the light-reflecting plates are substantially rectangular and each has at least two perforations spaced from one another along a lower edge thereof when arranged in the stack as mounted on the support, and the support includes a support member and at least two substantially U-shaped mounting members mounted on the support member and each extending through one of perforations of each of the light-reflecting plates, each of the mounting members as mounted on the support member having a substantially straight upper portion supporting the stack, a substantially straight lower portion supporting those light-reflecting plates which have descended by gravity from the stack, and an arcuate connecting portion interconnecting the upper and lower portion and guiding the light-reflecting plates during their descent. Under these circumstances, the advancing means advantageously includes a pusher engaging the trailing light-reflecting plate of the stack from behind. In this situation, it is advantageous when the arrangement further includes means for holding the leading light-reflecting plate in the operative position prior to reaching the end position, the holding means including a holding member which extends into the path of advancement of the leading light-reflecting plate with th stack until deflected out of the aforementioned path in response to further advancement of the stack. It is advantageous when the holding member engages the leading light-reflecting plate at an upper portion thereof.

According to another advantageous facet of the present invention, each of the light-reflecting plates has at least one bore therethrough which has an internal thread. Then, the support includes a support member and an elongated mounting member having an externally threaded free end portion received in the bore of each of the light-reflecting plates of the stack and meshingly engaging the internal thread of such bore. When the light-reflecting arrangement is constructed in this manner, the advancing means preferably includes means for rotating one and preventing rotation of the other of the mounting member and stack relative to the support member so that the stack advances along th threaded end portion due to the meshing engagement of the external and internal threads until the leading light-reflecting plate reaches the end position thereof beyond the free end of the threaded portion of the mounting member when the internal and external threads are disengaged and the leading light-reflecting plate is free to descend under the influence of gravitational forces. It is currently considered to be advantageous to mount the mounting member on the support member for rotation and to rotate the mounting member, while at least one guide is provided which extends along the stack and laterally engages the light-reflecting plates thereof to prevent the same from rotating with the mounting member.

In order to achieve best results, the replacing operation should be performed at the right time, that is, prior to the time at which the light-reflecting plate which then assumes the operative position thereof ceases to sufficiently reflect light impinging upon the same due to soiling thereof. The replacement can be performed manually by a maintenance worker who does not need any special tools or other equipment to accomplish this purpose. Nevertheless, this would still be ineffective, particularly since the maintenance worker would have to make the rounds either on foot or in a vehicle to reach and trigger the replacement operations in all traffic control devices assigned for maintenance to this maintenance worker. On the other hand, the replacement operation could also be triggered in response to the operation of a soiling sensor which would be aimed at the light-reflecting plate then assuming the operative position. This would be advantageous in the sense that the replacement operation would be triggered or performed at those times when the respective light-reflecting plate is actually soiled, irrespective of the time interval elapsing from the last replacement operation. However, this would also considerably and, in most instances, unnecessarily complicate the construction of the arrangement of the present invention. A much simpler solution which satisfactorily accomplishes the objects of the present invention resides in the employment of controlling means which so controls the advancing means as to replace the light-reflecting plate then assuming the operative position by the next-succeeding light-reflecting plate of the stack at a predetermined time. In other words, the controlling means controls the performance of the replacement operations in accordance with a predetermined time-succession program. The selection of the appropriate time-succession program which is optimum or the respective light-reflecting arrangement at its location of use depends on the conditions of operation of this particular light-reflecting arrangement, such as the external influences to which the arrangement is exposed at its location of use. If need be, the optimum time-succession program can be ascertained by experimentation or experience.

In order to be able to perform the replacement operation in an automatic manner, the advancing means has to be equipped with a drive capable of advancing the light-reflecting plates of the stack until all of such plates have been advanced toward and, with the possible exception of the last plate of the stack, beyond the operative position. Such a drive could be constructed, for instance, as a spring-loaded motor which is wound up at the time of introduction of a new stack of light-reflecting plates. However, a battery-energized motor could also be used instead. However, it is currently preferred when the drive is constructed, in accordance with the present invention, as an aneroid motor which is energized by pressure changes in the ambient atmosphere, or a motor which is energized by temperature fluctuations.

Other features which are considered as characteristic of the invention are set forth in particular in the appended claims. The light-reflecting arrangement, both to its construction and mode of operation, together with additional features and advantages, will be best understood upon perusal of the following detailed description of certain specific embodiments with references to the accompanying drawing.

BRIEF DESCRIPTION OF THE DRAWINGS

FIG. 1 is a perspective view of a roadside marker equipped with a light-reflecting arrangement according to the present invention;

FIG. 2 is a longitudinal sectional view through that part of the roadside marker of FIG. 1 which accomodates the arrangement of the present invention;

FIG. 3 is a cross-sectional view taken on line III—III of FIG. 2;

FIG. 4 is a perspective view of certain components of the arrangement illustrated in FIGS. 2 and 3;

FIG. 5 is a view similar to FIG. 2 taken along the line V—V of FIG. 6 showing a modification of the arrangement of the present invention;

FIG. 6 is a cross-sectional view taken on line VI—VI of FIG. 5;

FIG. 7 is a fragmentary sectional view corresponding to FIG. 5 and illustrating a further modification of the arrangement of the present invention;

FIG. 8 is a block diagram of a pressure-energized drive which may be used for driving the arrangement of the present invention; and FIG. 9 is a block diagram of a thermally energized drive which can be used for driving the arrangement of the present invention.

DETAILED DESCRIPTION OF THE PREFERRED EMBODIMENTS

Referring now to the drawing in detail, and first to FIG. 1 thereof, it may be seen that the reference numeral 1 has been used to identify a traffic control or guidance device, here illustrated as a roadside marker, in its entirety. It should be appreciated that the use of the arrangement of the present invention in a roadside marker post (that is, a post situated at the outer edge of the roadway or of the shoulder, especially in a curve, and making the driver aware, especially at night, of the fact that his or her vehicle is approaching the curve or, generally speaking, about the limits of the highway) is exemplary only and that the arrangement of the present invention can be used, for the same purposes and with the same advantages, in other traffic signs or traffic control or guidance devices.

As illustrated, the roadside marker post 1 is constructed as a hollow housing of a substantially triangular cross section, the housing being closed at its upper end. Advantageously, the road marker post 1 is made of synthetic plastic material. When this road side marker 1 is mounted at its location of use, that is, at the outer edge of the roadway or of the shoulder, it assumes an upright orientation corresponding to that shown in FIG. 1 and in such a manner that the side visible to the observer of FIG. 1 faces the road. As illustrated, the post 1 is intended for use in countries adhering to the right-hand driving convention. The post 1 includes a rectangular reflector 2 which is arranged behind a rectangular opening 3 of the post 1, this reflector 2 facing opposite the direction of travel of vehicles in the lane closest to the post 1. The roadside marker post 1 further includes two circular reflectors 4 and 5 which face in the direction of travel of vehicles in the closest lane. The reflectors 4 and 5 are arranged behind correspondingly circular openings 6 and 7 of the roadside marker post 1, the reflectors 4 and 5 and the openings 6 and 7 being arranged above one another. As shown, for instance, in FIG. 2, the reflectors 2, 4 and 5 are formed by light-reflecting surfaces 9 of respective light-reflecting plates 15. As will be explained in detail below, the light-reflecting plates 15 are automatically substituted for one another by means of a substituting arrangement which is concealed in the enterior of the post 1 and is not visible in FIG. 1, the substituting arrangement being so operated as to replace the respective plate 15 which may have become soiled while assuming its operative position behind the respective opening 3, 6 or 7, by a clean light-reflecting plate 15, so that the reflectors 2, 4 and 5 will reflect light impinging thereon over an extended period of time.

As shown particularly in FIGS. 2 and 3, the reference numeral 10 identifies that portion of the roadside marker post 1 which accommodates the light-reflecting arrangement of the present invention which constitutes any one of the reflectors 3, 4 or 5, while the corresponding opening 3, 6 or 7 has been indicated in FIGS. 2 and 3 by the reference numeral 11 constituting. The arrangement according to the present invention has been generally identified in FIG. 2 by the reference numeral 12. The arrangement 12 is accommodated in the interior of the portion 10 of the post 1, and is loaded with a stack 13 of clean light-reflecting plates 15. As illustrated in FIG. 2, some of the light-reflecting plates 15 have already been previously used, and such used light-reflecting plates 15 are illustrated as being collected in another stack 14. As illustrated particularly in FIg. 4, each of the light-reflecting plates 15 is a stiff or rigid rectangular plate having two perforations 16, 17 arranged in the vicinity of the lower edge of the respective light-reflecting plate 15. The plates 15 are so mounted on respective mounting members or brackets 20 and 21 that respective straight upper portions 18, 19 of these brackets 20, 21 extend through associated perforations 16, 17 of the light-reflecting plates 15 of the stack 13. The brackets 20, 21 further include straight lower portions 22, 23 which extend through the associated perforations 16, 17 of those plates 15 which accumulate in the stack 14 of used light-reflecting plates. The portions 18 and 22 of the bracket 20, and the portions 19 and 23 of the bracket 21 are respectively connected to one another by arcuate transition portions 24, 25 which guide the light-reflecting plates 15 during their travel from the stack 13 toward the stack 14. The two bracket 20, 21 are inserted into a housing of a drive 26 of the substituting arrangement 12 and can be pulled out of and reintroduced into the housing of the drive 26 by hand.

When the brackets 20 and 21 are dissociated from the housing of the drive 26 and removed from the interior of the portion 10 of the post 1 through the opening 11, the stack 14 of used light-reflecting plates 15 can be removed from the lower portions 22, 23 of the brackets 20, 21 and a fresh stack 13 of the light-reflecting plates 15 can be placed onto the upper portions 18, 19 of the brackets 20, 21. Thereafter, the free ends of the portions 18, 22, 19, 23 of the brackets 20, 21 are reintroduced into the housing of the drive 26 to assume the positions illustrated in FIGS. 2 and 3.

A pusher 28 engages the backside of a trailing or rearmost light-reflecting plate 27 of the stack 13. The pusher 28 is movable by the drive 26 in and opposite to the direction indicated by an arrow 29. The pusher 28 is moved or advanced in the direction of the arrow 29 in a stepwise or gradual manner by the drive 26 which may be a conventional construction or which may be constructed as will be described below. As a result of the action of the drive 26, the pusher 28 advances the stack 13 in the direction of the arrow 29 until the respective leading light-reflecting plate 15 indicated in FIG. 2 at 31 overcomes the holding action of an elastic holding member 32 engaging the leading plate 31 at its upper margin and bypasses the holding member 32 to descend by gravity, as illustrated in FIG. 2 for a light-reflecting plate 33, to join the lower stack 14 of used light-reflecting plates 15, as a rearmost plate 8 of the stack 14. The operation of the drive 26 is controlled by a control unit CU of conventional construction which has not been illustrated in any detail. Suffice it to say that the control unit may be constructed, for instance, as an escape mechanism in the event that the drive 26 is constituted by a spring-energized clockwork mechanism, in which event the light-reflecting plates 15 will be substituted for one another at predetermined time intervals. However, it is also contemplated to construct the control unit CU as a time of conventional construction which then controls the operation of the drive 26 in accordance with a predetermined program. The advancement of the pusher 28 by the drive 26 may be gradual, or stepwise. During the reloading of the arrangement 12, that is, after the mounting of a new stack 13 on the brackets 20, 21 the pusher 28 is manually displaced opposite to the direction of the arrow 29 into its retracted position which is illustrated in phantom lines in FIG. 2.

As illustrated in FIG. 4, the respective light-reflecting plate 15 has the light-reflecting surface 9 on its front side as viewed in the direction of advancement of the plate 15 of the stack 13 along the upper portions 18 and 19 of the brackets 20 and 21. Under these circumstances, the leading light-reflecting plate 31 of the stack 13 assumes its operative position and reflects the light which passes through the upper half of the opening 11. Instead, each of the light-reflecting plates 15 can be provided with the light-reflecting surface 9 on its rear side, that is, that side which faces away from the observer of FIG. 4. Then, the last light-reflecting plate 8 of the stack 14 assumes the operative position and reflects the light which passes through the lower half of the opening 11. However, it is also possible to provide both sides of each of the light-reflecting plates 15 with respective light-reflecting surfaces or layers 9. When this expedient is resorted to, two light-reflecting plates 15, that is, the leading plate 31 of the stack 13 and the last plate 8 of the stack 14 as shown in FIG. 2, assume their operative positions, in that the front-side light-reflecting surface of the plate 31 and the rear-side light-reflecting surface 9 of the plate 8 are exposed to view.

Turning now to FIGS. 5 and 6, it may be seen that the reference number 40 has been used to denote that portion of the roadside marker post 1 which accommodates a modified arrangement according to the present invention, here designated in general as 41. The substituting arrangement 41 is equipped with two stacks 42 and 43 of clean light-reflecting plates 36. A respective leading plate 44 of the stack 42 assumes its operative position in which it is situated behind two openings 45, 46 which correspond to the openings 6 and 7 of FIG. 1 and are arranged above one another. On the other hand, a leading light-reflecting plate 47 of the stack 43 assumes its operative position behind a rectangular opening 48 which corresponds to the opening 3 of FIG. 1. All of the light-reflecting plates 36 are provided with registering threaded bores 37, 38. The arrangement 41 includes threaded portions 50 and 51 which are rotably mounted, in a cantilevered fashion, on a bearing or support member 52 which is stationarily mounted on the portion 40 of the post 1, and they meshingly engage the respective threaded bores 37, 38 of the light-reflecting plates 36 of the respective stacks 42 and 43. The threaded portions 50, 51 are driven, via individual bevel gears 53, 54 meshing with a common bevel gear 55, from a drive 56, the sense of rotation of the threaded portions 50, 51 being such that, depending on the pitch direction of the threaded portions 50, 51, the light-reflecting plates 36 are advanced forwardly toward the openings 45 or 46 during the rotation of the threaded portions 50, 51. The light-reflecting plates 36 are laterally engaged by guides or slide walls 36 or 35 which are stationarily mounted on the portion 40 of the post 1 and which serve to prevent the light-reflecting plates 36 of the stacks 42 and 43 from sharing in the rotation of the threaded portions 50 or 51.

The respective light-reflecting plate 36 which constitutes the leading plate 44 or 47 of the respective stack 42 or 43 and which assumes its operative position advances, during the further rotation of the respective threaded portion 50, 51, beyond the free end of the respective threaded portion 50, 51 into an end position from which it descends by gravity as illustrated in FIG. 5 for a light-reflecting plate 58. During its gravity descent, the light-reflecting plate 58 contacts a reflector 59 which causes the plate 58 to travel, in a predetermined orientation, into a plate-collecting receptacle 60 arranged at the lower end of the portion 40 of the post 1. Herein, the reflection surfaces or layers 9 are arranged at those sides of the light-reflecting plates 36 which face the openings 45, 46, 48. The end faces of the threaded portions 50, 51 can also be made light-reflecting by being coated by a layer of light-reflecting material. However, it is also possible, in an alternative differing from the construction illustrated in FIG. 5, that the threaded portions 50 and 51 can be so arranged that they are not aligned with the respective openings 45, 46 or 48, in which event the light-reflecting plates 36 may have correspondingly larger dimensions.

In the modification illustrated in FIGS. 5 and 6, the leading or foremost light-reflecting plate 44 or 47 of the respective stack 42 or 43 is in its operative position and reflects any light impinging upon the same. However, it is also possible, for instance, as illustrated in FIG. 7, to deprive the respective leading light-reflecting plate 45 or 47 of the respective stack 42 or 44 of its reflecting function for the time being, and use the light-reflecting properties of the light-reflecting plates 36 only after they have descended from the respective stacks 42, 44 and have been captured and held in their operative positions as illustrated in FIG. 7 at 62. In FIG. 7, that portion of the roadside marker post 1 which accomodates the light-reflecting plate 62 in its operative position has been indicated at 66, the portion 66 including an opening 62 which may constitute any one of the openings 3, 6 or 7 of FIG. 1. The light-reflecting plate 62 which assumes the position illustrated in FIG. 7 is so oriented that its light-reflecting surface or layer 9 faces the opening 61. The light-reflecting plate 62 is supported on a movable holding element 63 which forms a component of a modified substituting arrangement of the present invention and is operatively connected to a drive of a conventional construction which has been omitted from FIG. 7. The holding element 63 is mounted on an actuating arm 64 which is periodically displaced, in a manner yet to be discussed, by the non-illustrated drive between the illustrated extended position and a retracted position. The arm 64 further carries a leaf spring 65 which engages the light-reflecting plate 62 from behind and presses the same against the sections of the portion 66 which surround the opening 61, in the illustrated extended position of the arm 64.

During the substituting operation, the actuating arm 64 is retracted from its illustrated extended position into a retracted position in which the holding element 63 is withdrawn from the path of gravity descent of the plate 62 and the leaf spring 65 ceases to engage the plate 62 so that the latter is free to gravitationally descend toward and beyond the deflector 59 on its way toward the collecting receptacle 60 which is illustrated in FIG. 5. At the same time, or shortly thereafter, the leading light-reflecting plate 44 or 47 of the respective stack 42 or 43 dissociates itself from the respective stack 42 or 43 in the manner discussed above in connection with FIGS. 5 and 6 and descends by gravity into the operating range of the holding element 63 which, in the meantime, has been returned into its illustrated extended position so that it captures and holds the next-succeeding plate 44 or 47 which then asssumes the operative position previously assumed by the plate 62. In this case, the openings 45 and 46 located at the elevation of the respective stacks 42, 43 may be, and usually are, omitted, their function being performed by the opening 61. The modification illustrated in FIG. 7 can be used in conjunction with a single stack 42, 43, or with two stacks 42 and 43 corresponding to those shown in FIGS. 5 and 6. Under these circumstances, the same provisions are made for the other stack as discussed above so that even here the respective leading light-reflecting plate of this stack reaches its end position from which it descends toward its operating position in which it is captured and held until release for further descent into the collecting receptacle.

As mentioned before, the substituting arrangements 12 or 41, as well as the non-illustrated substituting arrangement of the modification of FIG. 7, are equipped with respective drives, such as the drives 26 and 56. Such drives may be constituted by battery-energized electromotors, manually windable spring-loaded motors or the like. However, it is currently preferred to employ drives which will now be discussed in connection with FIGS. 8 and 9.

As may be seen in FIG. 8, the reference numeral 80 indicates a manometer-type container, that is, an evacuated, air-tightly closed, otherwise hollow, container, the lower part of which is stationarily mounted and the upper part of which moves, as indicated by a double-headed arrow 81, in response to ambient pressure fluctuations. An actuating rod 82 is connected to the upper part of the container 80 to share the pressure-caused movements of the upper part in dependence on the ambient pressure fluctuations, in the directions indicated by the arrow 81. The pumping or oscillating movements of the rod 82 resulting from this shared movement of the latter are used to wind up a spring-energized motor 83, substantially in accordance with the same principles as a spring-loaded clockwork of an automatic wrist watch is being wound up by a mechanically moved swinging anchor. The spring-energized motor 83 drives a clockwork 84 which, after the expiration of a respectively predetemined time interval, triggers the spring-loaded motor 83 which then causes the substituting arrangement 12 or 41 to perform the substituting operation.

The arrangement illustrated in FIG. 9 differs from that illustrated in FIG. 8 only in that a bimetallic sensor or thermocouple 90 is being used instead of the manometer-type container 80. The bimetallic sensor is stationarily mounted on one of its ends and acts, at its other, free, end on a rod 91 which, as to its function, corresponds to the rod 82 of FIG. 8. Thus, the rod 91 shares in the movements of the free end of the bimetallic sensor 90 which are caused by temperature fluctuations and conducts movements as indicated by a double-headed arrow 92, these movements driving a spring-loaded motor 93 which cooperates with a clockwork mechanism 94 corresponding to the clockwork mechanism 84. Thus, here again the substituting arrangement 12 or 41 is triggered for performing a substituting operation at pre-selected time intervals.

In a further modification of the examples shown in FIGS. 8 and 9, the manometer-type container 80 or the bimetallic thermal sensor 90 can be used to directly advance the pusher 28 or rotate the common bevel gear 55, for instance, by means of a pawl cooperating with a ratchet wheel. When this expedient is resorted to, the ratchet is advanced or indexed by one tooth during each movement of the manometer-type container 80 or a bimetallic sensor 90 which exceeds a predetermined amplitude. This indexing motion, which occurs in a series of very small steps, can then be transmitted, for instance, via a reduction gear train, to the pusher 20 or to the common bevel gear 55 to drive the same.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. A light-reflecting arrangement, particularly for use in traffic control devices such as roadside markers, comprising a support; a stack of light-reflecting plates mounted on said support for successive advancement of the individual light-reflecting plates toward and beyond an operative position in which the respective light-reflecting plate is exposed to act as a reflector; and means for gradually advancing said light-reflecting plates of said stack to replace that light-reflecting plate which may have lost its reflecting capability while dwelling in said operative position by the next-succeeding light-reflecting plate of said stack.

2. The light-reflecting arrangement as defined in claim 1, wherein said light-reflecting plates are so mounted on said support that a leading one of said light-reflecting plates of said stack loses its footing upon reaching an end position and descends from said stack by gravity.

3. The light-reflecting arrangement as defined in claim 2, wherein said light-reflecting plates are so mounted on said support that said leading light-reflecting plate reaches said operative position prior to reaching said end position.

4. The light-reflecting arrangement as defined in claim 2, wherein said light-reflecting plates are so mounted on said support as to form another stack after their descent by gravity from said first-mentioned stack.

5. The light-reflecting arrangement as defined in claim 4, wherein said light-reflecting plates are so mounted on said support that said leading light-reflecting plate reaches said end position immediately prior to reaching said operative position.

6. The light-reflecting arrangement as defined in claim 2, and further comprising detaining means for capturing that light-reflecting plate which has just descended by gravity from said end position and for holding the same in said operative position until the time of replacement by the next-succeeding light-reflecting plate; and means for accumulating those light-reflecting plates which have been released by said detaining means.

7. The light-reflecting arrangement as defined in claim 6, wherein said detaining means includes a holding element extending into the path of descent of said light-reflecting plates from said end position in one position thereof, and retracted from said path in another position thereof for releasing said light-reflecting plates for further descent by gravity; and wherein said accumulating means includes a receptacle situated underneath said detaining means.

8. The light-reflecting arrangement as defined in claim 2, wherein said light-reflecting plates are substantially rectangular and each has at least two perforations spaced from one another along a lower edge thereof when arranged in said stack as mounted on said support; and wherein said support includes a support member and at least two substantially U-shaped mounting members mounted on said support member and each extending through one of said perforations of each of said light-reflecting plates, each of said mounting members as mounted on said support member having a substantially straight upper portion supporting said stack, a substantially straight lower portion supporting those light-reflecting plates which have descended by gravity from said stack, and an arcuate connecting portion interconnecting said upper and lower portions and guiding said light reflecting plates during their descent.

9. The light-reflecting arrangement as defined in claim 8, wherein said advancing means includes a pusher engaging the trailing light-reflecting plate of said stack from behind.

10. The light-reflecting arrangement as defined in claim 8, and further comprising means for holding said leading light-reflecting plate in said operative position prior to reaching said end position, including a holding member extending into the path of advancement of said leading light-reflecting plate with said stack until deflected out of said path in response to further advancement of said stack.

11. The light-reflecting arrangement as defined in claim 10, wherein said holding member engages said leading light-reflecting plate at an upper portion thereof.

12. The light-reflecting arrangement as defined in claim 2, wherein each of said light-reflecting plates has at least one bore therethrough having an internal thread; wherein said support includes a support member and an elongated mounting member having an externally threaded free end portion received in said bore of each of said light-reflecting plates of said stack and meshingly engaging said internal thread thereof; and wherein said advancing means includes means for rotating one and preventing rotation of the other of said mounting member and stack relative to said support member so that said stack advances along said threaded end portion due to the meshing engagement of said external and internal threads until said leading light-reflecting plate reaches said end position thereof beyond the free end of said threaded portion of said mounting member.

13. The light-reflecting arrangement as defined in claim 12, wherein said mounting member is mounted for rotation; wherein said rotating means is operative for rotating said mounting member; and wherein said preventing means includes at least one guide extending along said stack and laterally engaging said light-reflecting plates thereof.

14. The light-reflecting arrangement as defined in claim 1, and further comprising means for so controlling said advancing means as to replace the light-reflecting plate then assuming said operative position by the next-succeeding light-reflecting plate of said stack at a predetermined time.

15. The light-reflecting arrangement as defined in claim 1, wherein said advancing means includes a motor energized by pressure changes in the ambient atmosphere.

16. The light-reflecting arrangement as defined in claim 1, wherein said advancing means includes a motor energized by temperature fluctuations.

* * * * *